US005988648A

United States Patent [19]

Schmid

[11] Patent Number: 5,988,648

[45] Date of Patent: Nov. 23, 1999

[54] SEALING DEVICE AND METHOD FOR SEALING CONCRETE SEAMS

[75] Inventor: Rene P. Schmid, Oberweingen, Switzerland

[73] Assignee: Agrar Chemie AG, Switzerland

[21] Appl. No.: 08/875,226

[22] PCT Filed: Jan. 8, 1996

[86] PCT No.: PCT/EP96/00050

§ 371 Date: Oct. 17, 1997

§ 102(e) Date: Oct. 17, 1997

[87] PCT Pub. No.: WO96/22429

PCT Pub. Date: Jul. 25, 1996

[30] Foreign Application Priority Data

Jan. 18, 1995 [DE] Germany ..... 195 01 384

[51] Int. Cl.[6] ..... E04B 1/682

[52] U.S. Cl. ..... 277/316; 52/259; 52/396.02; 404/64

[58] Field of Search ..... 277/312, 316, 277/642, 641, 637, 628, 906; 52/396.02, 251, 259; 156/305; 404/56, 64, 65, 73, 74

[56] References Cited

U.S. PATENT DOCUMENTS

| | | | |
|---|---|---|---|
| Re. 29,777 | 9/1978 | Crowley | 52/259 X |
| 3,440,934 | 4/1969 | Dill | 404/65 X |
| 4,740,404 | 4/1988 | Otsugu et al. | 404/64 X |
| 5,249,401 | 10/1993 | Schmid | 52/396.02 X |
| 5,375,386 | 12/1994 | Goad | 404/69 X |

FOREIGN PATENT DOCUMENTS

| | | |
|---|---|---|
| 3924497 A1 | 1/1991 | Germany . |
| 9202319 U | 7/1992 | Germany . |
| 4217711 | 12/1993 | Germany . |
| 600077 | 12/1977 | Sweden . |

OTHER PUBLICATIONS

Greenstreak, Waterstops for Concrete Construction, Sweet's Engineering & Retrofit, vol. 1, McGraw Hill, New York, Section 03250/GRD, pp. 1–12, Mar. 1994.

Sweet's Catalog File, vol. 2, McGraw Hill, New York, sections 3.6/Mur, 3.6/GR, & 3.6/PRP, Jun. 1986.

"Abdichtung von Bauwerksfugen mit Fugenbändern" Dr.–Ing. Norbert Klawa, Bammental TIS Nov. 1984 pp. 662–672.

*Primary Examiner*—Lynne H. Browne
*Assistant Examiner*—Greg Binda
*Attorney, Agent, or Firm*—Harness, Dickey & Pierce PLC

[57] ABSTRACT

Sealing device for sealing a joint (2) formed between two sections (3, 4) to be concreted, whereby the sealing device is embedded in the sections (3, 4) so that it is positioned at a right angle to the abutting ends (5, 6) of the joint (2) opposite the concreted sections (3, 4), whereby the sealing device is formed as a thin-walled, strip-shaped joint rail (1) made of rigid plastic and its dimensional shape and its wall thickness are so dimensioned that it is self-supporting.

The rigid plastic is preferably a thermoplastic plastic, in particular HDPE, which is dimensionally stable in a temperature range of −20° C. to +80° C.

15 Claims, 5 Drawing Sheets

SEALING DEVICE AND METHOD FOR SEALING CONCRETE SEAMS

Figure 1:
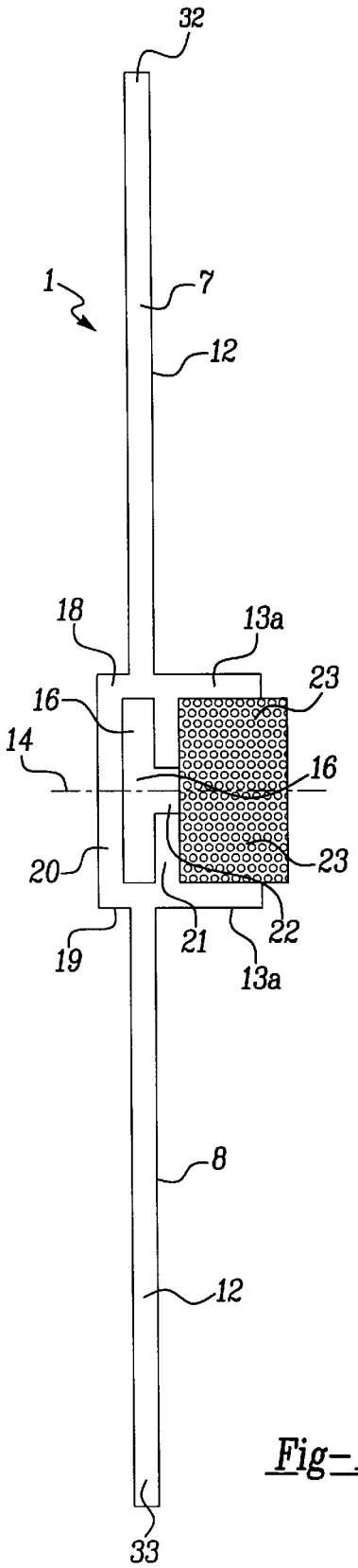
Figure 2:
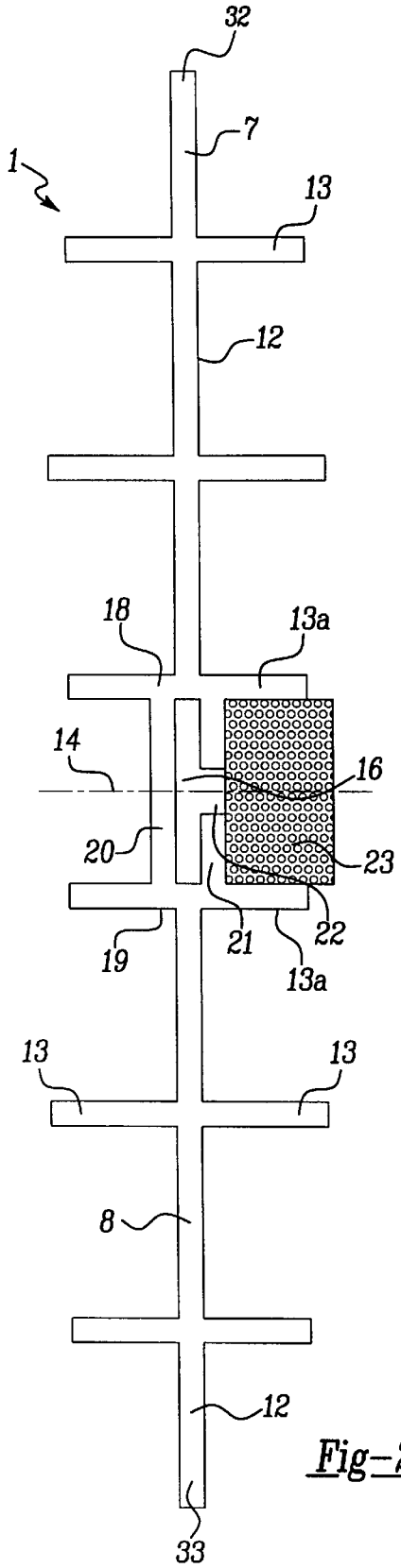
Figure 3:
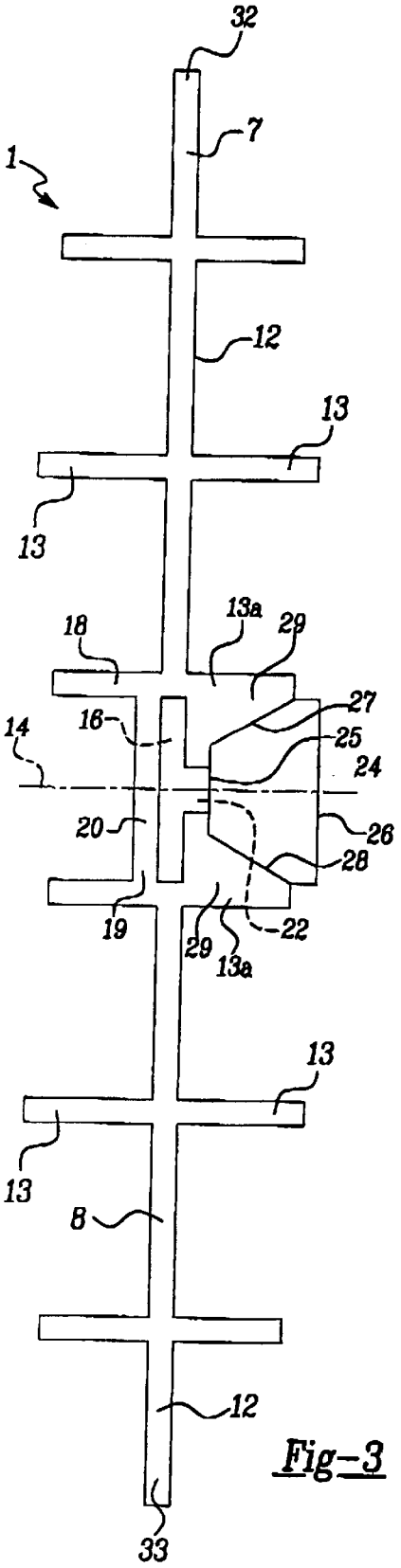

The invention concerns a sealing device for concrete joints.

The use of sheet-metal strips for the sealing of joints between the abutting ends of two segments to be concreted is known.

These sheet-metal strips are attached with tie wire or similar to the reinforcement set up in the segment to be concreted before the first segment is poured, or are inserted in suitable receiving slots in the reinforcement so that the sheet-metal strip is arranged more or less perpendicular and symmetrical to the abutting ends to be formed. The sheet-metal strip Is then concreted into the segments as they are being poured so that it blocks the joint and prevents the penetration of moisture through the joint.

The sheet-metal strips used normally have a width of 300 mm or more and a thickness of 3 to 4 mm. The individual strips are cut to size in a workshop and preshaped and connected by welding and soldering on site. A strip that has not been properly prepared cannot without further ado be reworked on site so that incorrect preparation of the strips can lead to considerable delay in the pouring of the segments.

The strips are susceptible to rust unless stainless metal is used which does not however bond well with the concrete. For a good bond between the sheet-metal strip and the concrete, use is therefore preferably made of strips with a rust film, because this results in a better bond between the metal and the concrete. However, a rusting strip poses a risk, because it may eventually rust through. Moreover, because of their thickness and width the strips are quite heavy so that for lifting and shifting a strip fabricated for a longer building segment it may be necessary to use a crane. Additionally, sheet-metal strips are only used in the form of plane elements, because a special dimensional shape involves considerable cost.

The strips-connected by welding and soldering are particularly susceptible to rust at their seams with the attendant risk of untightness.

An advantage of the metal strips is that they need not necessarily be Installed before the first concrete is poured, but that they can also be pressed into the still semifluid concrete shortly after the pouring of the first segment. In this case it is however necessary to recompress the concrete near the strip in order to ensure adequate bonding between concrete and strip and hence adequate tightness.

In summary it can therefore be said that although the metal strips can be easily attached to the reinforcement or subsequently pressed into the still semiliquid concrete. they require a good deal of handling for cutting to size, bending and joining and especially because of their corrodibility pose a serious risk of untightness.

Joint tapes of elastomer material are also used for the sealing of a joint between the abutting ends of two segments to be concreted. For effective sealing the cross-section of the joint tapes is formed in accordance with the labyrinth principle, whereby the joint tapes have grooves of trapezoidal or triangular cross-section which lengthen the waterway and at the same time reduce the pressure.

For proper functioning it is essential that the joint tapes are inserted correctly and direct contact with the concrete is necessary. The greatest stress on a joint tape occurs during insertion and every effort must therefore be made at this stage to avoid local excessive stress by stretching, flexure and crushing. Joint tapes must e.g. not be nallecl except for narrow outer edge strips specifically provided for this purpose. Particular attention must be paid that the elastic joint tape shanks do not double up and form pockets in the concrete which are almost impossible to seal later. This may particularly lead to voids, porous spots or grooves which enable the water to by-pass the strip. It is therefore necessary to attach joint tapes at relatively short intervals to the reinforcement in the segments to be concreted so that doubling up can be avoided with certainty. Adequate tightness is only achieved if the joint tapes are embedded in the concrete. The shanks of horizontally running joint tapes should be pulled up at an angle of ca. 15° to avoid air pockets in the concrete at the bottom of the strips.

The joint tapes are delivered to the site in rolls and because of their flexibility can be easily adapted to the configuration of the joint. They are cut to size on site and connected by vulcanisation. The vulcanisation is carried out with special vulcanising units by feeding in the raw material under pressure and heat. However, it is only possible to produce straight connections on site and therefore large subsystems containing sections of the joint tapes of an entire building segment with all the crossings and branches are delivered ready-made to the site. There are of course sets of right-angled shaped parts, but they generally are not adequate for a complete sealing system. The production of shaped parts for joint tapes must therefore be taken into account at an early stage of drawing up the design.

In summary it can therefore be said that joint tapes can be worked on site in the case of simple linear building segments, but more complicated construction work requires planning and shaped parts for joint tapes must be prefabricated. Moreover, the attachment of the strip to the reinforcement is quite labour-intensive and there is the risk that the strip doubles up resulting in voids, porous spots or nests.

To eliminate the problems just referred to, joint tapes with lateral metal strips have been developed, whereby the metal strip is vulcanised into the joint tape. Such joint tapes involve extra work and are therefore expensive and pose the same problems in handling as the above sheet-metal strips. Furthermore, a known practice is to mount an injection hose along both longitudinal lateral edges of the metal strips vulcantsed into the joint tape, whereby these hoses enable the subsequent injection of sealant into the joint area. The injection of sealant must take place on both sides to cut both waterways along the longitudinal lateral edges.

Additionally, in EP 0 418 699 A1 a sealing device for the injection of sealant into the joint area is described, consisting in a dome-shaped profile with open cross-section which is installed with the free longitudinal edges of its sides on a concrete surface so that a canal for the sealant between the profile and the concrete surface is formed. The sealant is injected under high pressure into the canal and exfiltrates between the free longitudinal edges of the profile on the concrete surface into cracks In the concrete. A further sealing device described in it, consists in a body made of a cellular material or foam strip with through-pores, preferably of rectangular cross-section, which is laid on the concrete surface so that the canal for a sealant is formed by the body itself, whereby the sealant exfiltrates from the through-pores into the joint area.

Furthermore, sealing hoses are known as e.g. described in CH-PS 600 077, consisting of a supporting body in the form of a coil spring surrounded by a first braided injection hose which in turn is surrounded by an outer meshlike porous hose. After installing these hoses and the concreting of the second segment a sealant is pressed into the tubular sealing device and should exfiltrate into cracks in the concrete.

For the sealing of concrete joints use is also made of expansion tapes which swell up under the influence of water. The expanding agent is a hydrophilic substance embedded in a carrier substance which normally is chloroprene rubber. The main purpose of the carrier substance is to give the expanding agent stability and elasticity. The hydrophilic (water-absorbing) component takes up water molecules and thereby increases its volume by a factor ranging from 1.5 to ca. 4. This creates a pressure of up to 6.5 bar which fills the surrounding voids and should make them impermeable to water. When using such expanding agents it must be taken into account that the expanding substance does not expand suddenly, but that it may take hours or days of slow expansion and therefore has limited application in areas where wet and dry periods alternate. An outstanding advantage of expansion tapes which is why they are often used, consists in their ability to provide reliable sealing for joints between different materials like e.g. concrete/plastic, concrete/iron etc.

The object of the invention is to create a sealing device for concrete joints which can be easily worked, handled, adapted to the particular building work and installed in the joint area and guarantees reliable sealing of concrete joints.

Furthermore, a method will be described with which a device as per invention can be inserted into a concrete joint securely and cost-effectively.

The object is met by a device with the characteristics as per claim 1. Further advantageous embodiments of the invention are described in the subclaims.

As the sealing device is in the form of a bar-shaped joint rail of rigid plastic, especially high density polyethylene (HDPE), which has good stiffness properties when handled, it can be inserted and embedded into the segments to be concreted just as easily as the known metal strips, but its handling is considerably easier because of its low weight. The joint rail can be easily adapted on site by hot-forming into complicated shapes, angles, roundings etc. e.g. by means of a hot air blower. The working of the joint rail can be carried out on site, whereby the cutting to size e.g. like the cutting to size of timber and the connection is carried out with a welding reflector or by hot-melt sealing so that in each case only small hand-held tools are required.

Moreover, the compatibility between concrete and/or the bonding agent and the rigid plastic is surprisingly good and results in high adhesive forces at the boundary surfaces. In an advantageous embodiment the surface is roughened or silica sand or similar fine-grained material is worked into the surface thereby further improving the bonding to the concrete.

In a further advantageous embodiment the joint rail is equipped with reinforcement webs projecting on its surface so that a high inherent rigidity is obtained even when thin material is used.

Embodiments of the invention are explained in more detail with the aid of the drawings Illustrations:

FIG. 1 through 6 illustrate in cross section different embodiments of the invention; and FIG. 7 through 11 illustrate different arrangements of a joint rail and reinforcement elements in wall segments.

The sealing device as per invention is intended for the sealing of joints 2 between two segments to be concreted 3, 4 (FIG. 7 to 11) and is designed as a strip-shaped or bar-shaped joint rail (FIG. 7 to 11) of rigid plastic, especially HDPE (high density polyethylene), whereby the dimensional shape and the dimensions are so designed that the joint rail which is in particular made of hot-workable rigid plastic has an inherent rigidity i.e. behaves like a slat, is flexible and resistant to breaking. The rigid plastic is preferably a thermoplastic plastic which is dimensionally stable and flexible in a temperature range of −20° C. to +80° C.

The stiff joint rail is relatively rigid so that it can be delivered to a building site in a stack of several pieces. The bar-shaped joint rail 1 is hot-formed e.g. bent on site e.g. with a hot air blower or another suitable heat source and adapted to the course of the joints 2 of the walling to be erected, whereby complicated shapes like angles, roundings etc. can be easily achieved.

The individual joint rails 1 are assembled to form a long continuous joint rail, whereby they are interconnected at their abutting ends by welding, fusing or by hot-melt sealing or cold bonding. This requires only small hand-held tools like e.g. a welding reflector or the like, which are easy to operate and by a simple process guarantee a tight connection. The joint rails 1 can also be assembled into crossing and branching elements and interconnected in the same manner so that any joint configuration can be sealed with them.

When erecting the wall section near the joint area 2 the joint rail 1 is arranged along the joint 2 and perpendicular to the abutting ends 5, 6 formed by the sections to be concreted 3, 4, whereby it is preferably positioned mirror symmetrically to the abutting ends so that in each case a shank 7, 8 of the rail 1 is embedded into a concreted section 3, 4.

Before the first concrete pour the joint rail 1 like the known metal strips is fastened to a reinforcement 9 e.g. with tie wire or similar, whereby because of its high inherent rigidity the joint rail 1 is self-supporting and therefore and because of its low weight can be attached at large intervals. When grouted in with concrete the reinforcement 9 and a shank 7, 8 of the joint rail are in each case enclosed form-locking by the concrete of the particular concreted section 3, 4 so that the joint rail 1 tightly bonds to the concrete as it sets and blocks the passage of water through the joint. Surprisingly, it has been found that the compatibility of the concrete with joint rails made of rigid plastic, particularly HDPE, is very good and because of high adhesive forces at the boundary surfaces produces tight bonding. The adhesion at the boundary surfaces can be improved by roughening of the surface of the joint rail 1 or working silica sand or similar fine-grained material into it so that even under unfavourable conditions a firm and tight bond is achieved between the joint rail 1 and the concrete.

In an advantageous embodiment the joint rail 1 has a main stem 12 of e.g. rectangular cross-section and on both sides has laterally projecting e.g. righ-tangled reinforcement webs 13 extending longitudinally, likewise of e.g. rectangular cross-section and integrally moulded onto the main stem (FIGS. 1 to 6). The reinforcing webs 13 preferably extend continuously over the entire length of the main stem 12 and increase the rigidity of the joint rail 1 so that the joint rail 1 made with reduced wall thickness will have equal inherent rigidity.

The reinforcing webs 13 are narrow winglike elements with preferably the same wall thickness as the main stem 12. They are crosspieces preferably arranged symmetrically around the plane of the main stem 12 and/or symmetrically around a plane across the centre 14 perpendicular to the main stem 12. The reinforcing webs lengthen the waterway in the manner of a labyrinth seal and so contribute to increased tightness.

The reinforcing webs 13 of a joint rail 1 can all have the same width i.e. lateral projector from the main stem, or a different width.

Advantageously, the reinforcing webs 13 project laterally from the main stem, 0.5 cm to ca. 2 cm. For an ideal stiffening four to eight reinforcing webs 13 interspaced at ca. 2.5 to 5 cm can be provided on a side faco of a main stem 12. The width of the main stems 12 as measured from top to bottom in FIG. 1 to 6 ranges from 15 to 30 cm and is preferably 20 to 25 cm and the thickness is 3 to 6 mm, preferably 4 to 5 mm. The wider the main stem 12, the more reinforcing webs 13 it should have. The thin-walled reinforcing webs 13 are attached to the main stem 12 at right angles.

According to the invention the joint rail 1 (FIGS. 1 to 6) is e.g. combined in the area across its center and in the joint area of the concrete bodies with an injection canal 16 already known as such which makes subsequent sealing of the construction joint 2 by injection of sealant into defects in the joint area possible. The injection canal 16 is positioned between the segments to be concreted 3, 4 in the area of the construction joint 2, whereby orientation both towards the water face and away from the water face is possible. As regards the injection technique with sealant, reference is made to the state of the art, in particular to EP 0 418 699 A1.

The integrally moulded-on injection canal 16 is bounded by a roof and floor 18, 19 arranged perpendicularly to the main stem 12 and by two sides 20, 21. The sides 20, 21 are offset laterally in relation to the main stem 12, whereby they are spaced apart by approximately the thickness of the main stem 12. The walls 18 to 21 therefore form a canal of rectangular cross-section.

One of the two sides 20, 21 has an opening 22 through which the injected sealant can exfiltrate. The opening 22 is a slot extending over the full length of the joint rail 1. However, it may also be in the form of several vertically offset holes, in particular longitudinally arranged oblong holes, so that the side 20, 21 with the opening 22 is stiff and performs a supporting and reinforcing function on the joint rail 1.

Preferably the floor and roof 18, 19 are extended on the side of the opening 22 or on both sides to form reinforcing webs 13*a* so that together with the adjacent side 21 which has the opening 22 they bound a U-shaped recess or channel for holding an open-cell foam strip 23. During injection of sealant the foam strip 23 fills with sealant and so forms a further canal section running parallel to the injection canal 16 for receiving and distributing the sealant. the cell size of the open-cell foam strip 23 is so selected that during the concreting no concrete penetrates into the injection canal 16 through the opening 22. However, the foam strip 23 is permeable for the sealant injected under pressure into the injection canal 16 so that the sealant can spread outwards into an undesired void and fill and seal it.

In a special embodiment the opening 22 of the injection canal 16 is covered by a closed-cell foam strip 24 e.g. of elastic material which is impermeable to the sealant. In cross-section the closed-cell foam strip 24 has an approximately trapezoidal shape with an inner narrow face 25 covering the opening 22, an outer broad face 26 and two inclined sides 27, 28 between the narrow face 25 and the broad face 26. The cross-sectional shape of the channel bounded by the sides 20, 21 and the reinforcing webs 13*a* has been adapted to the shape of the closed-cell foam strip by moulded-on cross-sectionally triangular walls 29 between the side 21 and the reinforcing webs 13*a*, whereby these walls 29 form an inclined side corresponding to the inclined sides 27, 28.

If after the pouring and setting of the concrete, sealant is injected under pressure in a manner and by means already known as such into the injection canal 16, it lifts the foam strip 24 from the inclined sides of the channel in an action resembling the lifting of a valve and can exit into adjacent voids. As this occurs, the foam strip is compressed. When the pressure decreases the foam strip 24 returns to its initial dimensional shape so that it lies flat against the inclined sides of the channel of the joint rail 1 again and like a valve closes the opening 22 of the injection canal again.

Figure 4:
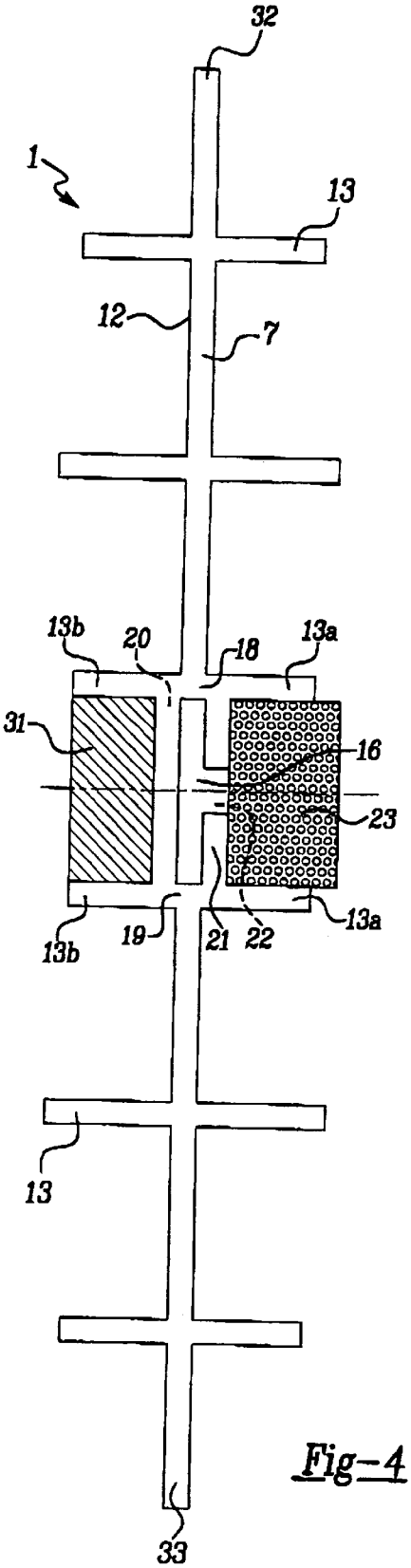
Figure 5:
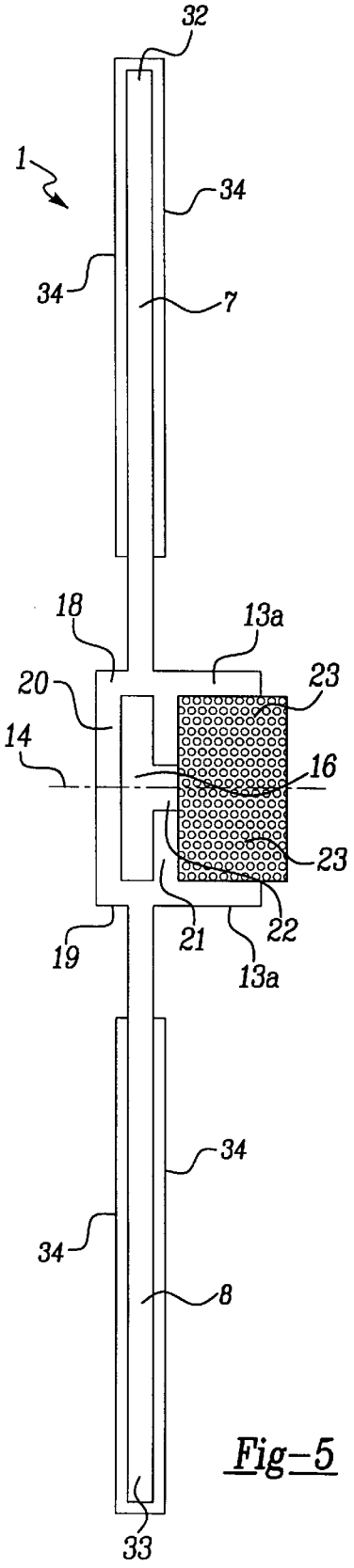
Figure 6:
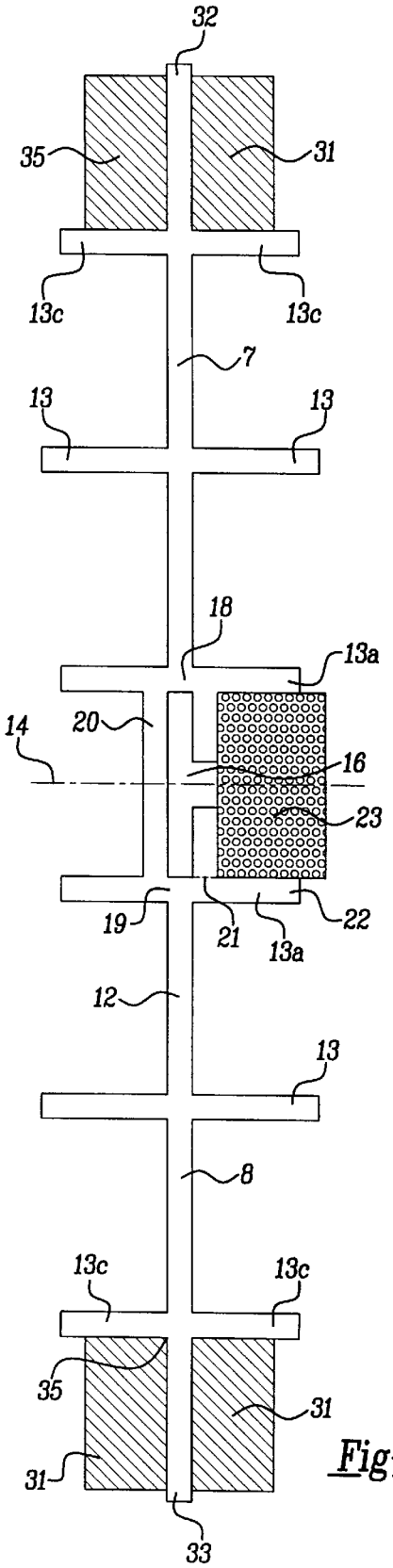

In addition to an injection canal 16 the joint rail 1 may also have an expansion tape 31 in the area across its centre and the joint area (FIG. 4). The expansion tape 31 is enclosecd form-locking in a U-shaped recess or channel/groove formed by the main stem 12 and two reinforcing webs 13*b* arranged in the area across the center, whereby on one side of the main stem 12 an expansion tape 31 and on the other side an injection canal is arranged. Both the expansion tape 31 and the injection canal 16 are arranged across the center of the joint rail 1 which when the joint tape is installed is located in the joint area of the concrete bodies 3, 4.

In a particularly effective and yet simple embodiment (FIGS. 11 to 15) the joint rail 1 additionally or alternatively has an expansion device like e.g. an expansion foil 34 or an expansion tape 31 along its outer longitudinal lateral edges 32, 33. The longitudinal lateral edges 32, 33 are the areas of the joint rail 1 which are immersed most deeply in the segments to be concreted 3, 4 so that the probability of the formation of defects of any kind is extremely small as the expansion device in this area forms a perfect fit between the concrete around the joint rail 1 and the joint rail 1 and even under difficult conditions guarantees a tight joint.

The joint rails 1 with expansion foil 34 preferably do not have reinforcement webs 13, because the expansion foil can be glued more easily to the flat shanks 7, 8 of the joint rail 1. The expansion foils 34 extend from the outer longitudinal lateral edges 32, 33 to about ⅔ to ⅘ of the shank width of the joint rail 1.

If the joint rails 1 are equipped with expansion tapes 31 along their longitudinal lateral edges 32, 33 (FIG. 6) then preferably joint rails with reinforcing webs 13 are used, whereby the expansion tapes 31 are glued into a corner recess 35 formed by the outermost reinforcement web 13*c* and the end of the main stem 12. Preferably such a joint rail 1 has four expansion tapes 31, whereby on each longitudinal lateral edge 32, 33 on both sides of the main stem 12 an expansion tape 31 is arranged.

Figure 7:
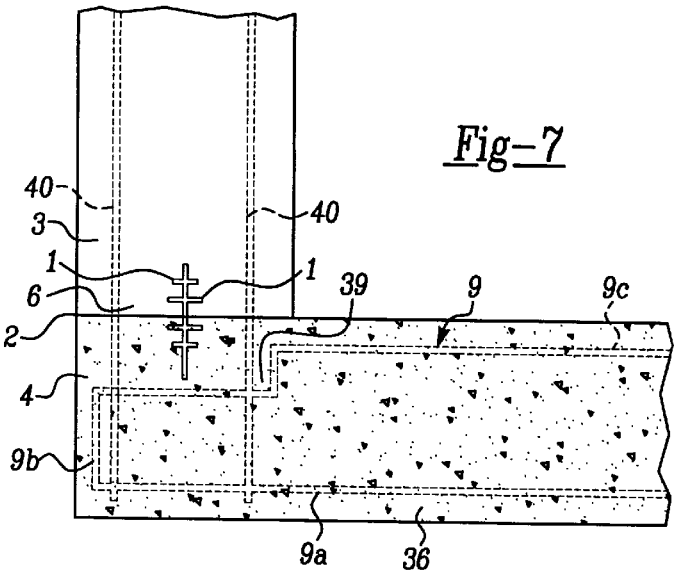
Figure 8:
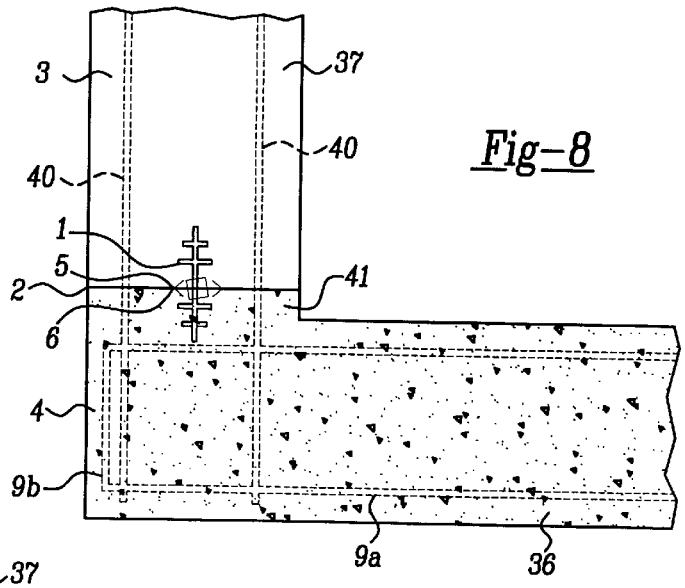
Figure 9:
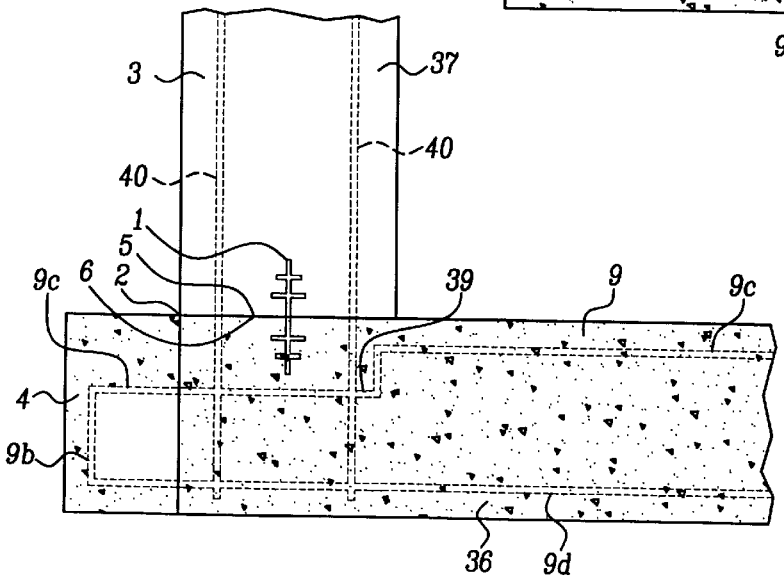
Figure 10:
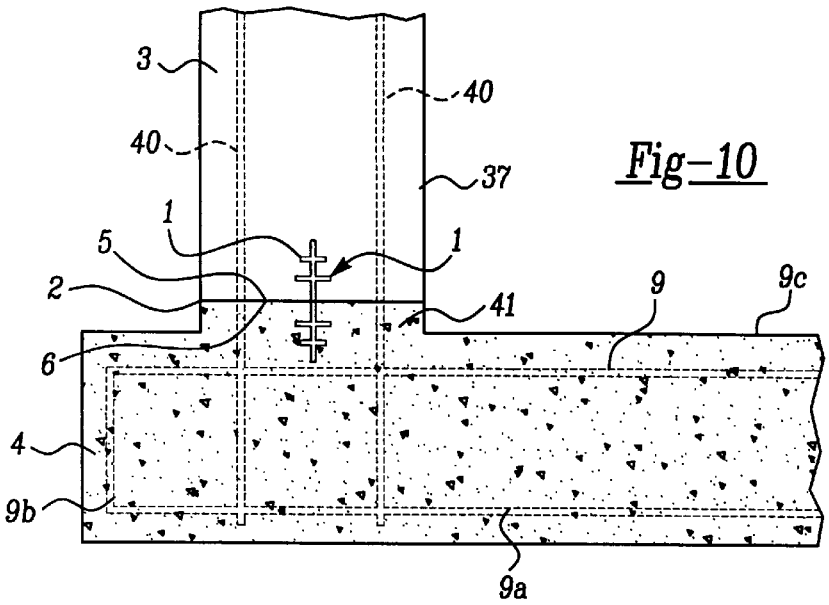
Figure 11:
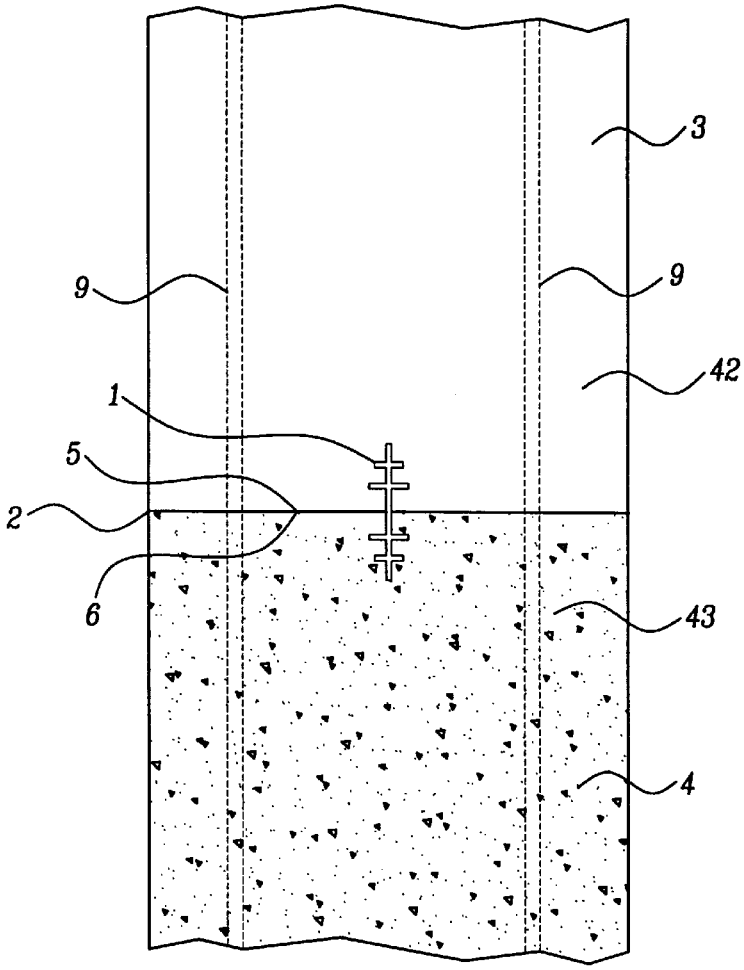

The reinforcement 9 in the segments to be concreted 3, 4 must be so arranged that it does not cross the joint rail 1 (FIGS. 16 to 20). In the case of a joint between a floor slab 36 and a wall segment 37 this can e.g. be achieved by stepping down the reinforcement 9 of the floor slab 36 underneath the joint 2. The reinforcement 9 then has e.g. in cross-section the shape of a U lying on its side with an open side, with a lower area 9*a*, a lateral connecting area 9*b* and an upper area 9*c*. Outside the joint area the upper area 9*c* is arranged, as is usual, close under the surface of the floor slab 36, whereby towards the area under the joint 2 it has been stepped down and therefore runs at some distance from the surface (FIG. 7). Inserted into the wall segment 37 there are vertical reinforcement rods 40 running parallel with the joint rail 1 and therefore not crossing it.

The spacing between the joint 2 and the reinforcement 9 of the floor slab 36 can also be achieved by a step-shaped extension 41 on the floor slab 36 (FIG. 8), whereby the extension 41 in the area below the wall segment 37 is integrally cast with the floor slab 36 and extends upward from the floor slab 36 with a width and length identical to that of the wall segment. In this wall extension 41 the lower shank 8 of the joint rail 1 is cast in and has sufficient space, so that it does not cross the transverse reinforcement 9 of the floor slab 36. The upper shank 7 of the joint rail 1 is embedded in the wall segment 37 standing on the floor slab 36.

For the connection of two stages 42, 43 (FIG. 11) of a floor slab and a wall segment the joint rail is arranged at right angles to the joint 2 and therefore parallel to the floor slab and the reinforcement element in the wall segment so that the reinforcement and the joint rail do not cross.

To improve the holding force between the joint rail 1 and the surrounding concrete and/or the bonding agent, the surface of the joint rail is roughened. Preferably silica sand or a similar fine-grained material is worked into the surface of the joint rail 1 resulting in an ideal connection between the joint rail and the surrounding concrete.

Right-angled standardised shaped parts of the joint rail 1 as per invention for crossings and branchings with threc or four shanks can be easily adapted on site to the particular construction work by fixing two or three shanks in position and heating the shaped part in the connection area so that the one free shank can be bent into a desired angle. The bent shaped parts are then connected to bar-shaped joint rails 1 in the manner described above.

I claim:

1. Sealing device for sealing a joint (2), which is formed between abutting surfaces (5, 6) of two concrete-application sections (3, 4), where the sealing device includes a thin-walled, strip-shaped joint slat (1) as a sealing element, which is made of a hard plastic material, for which the type of material, spatial configuration and wall thickness are chosen in such a manner, that the joint slat (1) is self-supporting, wherein the joint slat (1) is cast integral in both concrete sections (3,4) with the joint slat (1) perpendicular with respect to the abutting surfaces (5, 6) of the concrete sections (3, 4) which form the joint (2) and where the joint slat (1), in the region of its longitudinal center, includes members defining an injection canal (16) with at least one injection opening (22) and a flat main stem extending longitudinally off said members, said at least one injection opening being oriented laterally with respect to said flat main stem, whereby the injection canal (16) is located between the concrete-application sections (3, 4) in the region of the joint (2), and the injection opening (22) can be located in such a manner that it points toward the joint (2).

2. Sealing device according to claim 1 wherein the hard plastic is a thermoplastic material which is dimensionally stable over a temperature range from −20° C. to +80° C.

3. Sealing device according to claim 1, wherein the joint slat (1) includes laterally projecting reinforcing webs or ribs (13), which are extended in the longitudinal direction.

4. Sealing device according to claim 3, wherein the main stem (12) and the reinforcing webs (13) have the same wall thickness and that the wall thickness lies in a range of between 3 to 6 mm.

5. Sealing device according to claim 3, wherein the reinforcing webs (13) have been formed as a part of the main stem (12) at an approximately right angle to it.

6. Sealing device according to claim 3, wherein the width of the main stem (12) lies in a range of between 15 and 30 cm, and that the reinforcing webs (13) project laterally from the main stem (12) from 0.5 cm to about 2 cm.

7. Sealing device according to claim 1, wherein the joint slat (1) has exterior lateral edges (32, 33), which are equipped with an expansion agent thereon.

8. Sealing device according to claim 1, wherein the joint slat (1) includes four expansion tapes (31), which are each attached at a corner recess (35), which is formed by the regions of the joint slat (1), which are located at the lateral edges (32, 33), and in each case by one of the exterior reinforcing webs (13*c*).

9. Sealing device according to claim 1, wherein the injection canal (16) has an approximately rectangular cross-section and is formed in one piece at the joint slat (1), with a top wall and a bottom wall (18, 19) and two side walls (20, 21), where at least one of the side walls (20, 21) includes the opening (22) as the outlet of sealing material.

10. Sealing device according to claim 9, wherein the opening (22) is covered with a strip of open-cell cellular material (23), which forms a further canal section, which proceeds parallel to the injection canal (16).

11. Sealing device according to claim 9, wherein the opening (22) is covered by a closed-cell cellular material strip (24), which has a trapezoidally shaped cross-section and where the surface of a narrow side (25) is adjacent to the opening (22) at its interior side, and an exterior surface of a wide side (26) and two oblique surfaces (27, 28), which are extended between the surface of the narrow side (25) and the surface of the wide side (26), where the joint slat (1) has reinforcing webs (13*a*) in the region of the injection canal (16), which are tightly joined to the oblique surfaces (27, 28).

12. A method for sealing a joint (2) between two concrete sections (3, 4) having abutting surfaces (5, 6) comprising the steps of providing a joint slat which is thin-walled, strip-shaped, and made out of a hard plastic material, and where its material, its spatial configuration and wall thickness are dimensioned in such a manner, that it is self-supporting, pouring the concrete sections (3, 4) onto the joint slat (1) with the joint slat (1) perpendicular with respect to the abutting surfaces (5, 6) of the joint (2), which are located opposite to the concrete sections (3, 4), while the joint slat (1), which includes an injection canal (16) in the region of its longitudinal center with at least one injection opening (22), placed in such a manner that the injection canal (16) is located in the region of the joint (2).

13. The method according to claim 12, wherein a sealing material is injected into the injection canal (16), which exits through the opening (22) in one of the two side walls (20, 21) forming the injection canal (16).

14. The method according to claim 12, wherein the joint slat (1), is adapted to a required construction process on the site by means of sawing, by the application of heat, where individual sections of the joint slat are joined to each other by welding or by a heat sealing process, and where the joint slat prepared in this manner is attached to a reinforcing member or to a concrete form part transversely to the joint, which is being poured, either before the first concrete-application process, or it is pushed into the still highly viscous concrete after the first concrete-application process.

15. The method according to claim 14, wherein the rectangular form parts of the joint slat (1) are bent on the construction site and are joined to each other by means of the main stem (12).

* * * * *